US007494083B1

(12) United States Patent
Yen

(10) Patent No.: US 7,494,083 B1
(45) Date of Patent: Feb. 24, 2009

(54) REEL STRUCTURE

(76) Inventor: Hsu-Li Yen, 3F-2, No. 13, Wu Chuan 1 Rd., Hsin Chuang City, Taipei Hsien (TW)

( * ) Notice: Subject to any disclaimer, the term of this patent is extended or adjusted under 35 U.S.C. 154(b) by 0 days.

(21) Appl. No.: 11/882,969

(22) Filed: Aug. 8, 2007

(51) Int. Cl.
*B65H 75/48* (2006.01)

(52) U.S. Cl. ..... 242/378.1; 242/385.4

(58) Field of Classification Search ..... 242/378, 242/378.1, 385.4, 396.2
See application file for complete search history.

(56) References Cited

U.S. PATENT DOCUMENTS 1,945,842 A * 2/1934 Witchger ..... 33/767
4,417,703 A * 11/1983 Weinhold ..... 242/378.3
5,014,437 A * 5/1991 Sun ..... 33/414
5,178,619 A * 1/1993 Galazaka ..... 606/41
6,997,410 B1 * 2/2006 Huang ..... 242/378.3
7,147,177 B2 * 12/2006 Yen ..... 242/385.4

* cited by examiner

*Primary Examiner*—Sang Kim
(74) *Attorney, Agent, or Firm*—Rosenberg, Klein & Lee

(57) ABSTRACT

An improved reel is described. The reel includes a fine-tuning structure for adjusting the length of wires or cords drawn from the reel and a button component for winding the wires or cords. Thereby, the length of cords or wires is adjusted to a desired level in multiple stages as necessary, and the cords or wires of such reel are collected quickly and smoothly.

1 Claim, 4 Drawing Sheets

REEL STRUCTURE

BACKGROUND OF THE INVENTION

1. Field of the Invention

The present invention generally relates to a reel, and more particularly, to an improved structure of a reel including a fine-tuning structure for adjusting the length of wires or cords drawn from the reel and including a button component for winding the wires or cords, which is used to control reeling in and out the cords or wires of manifold devices such as electronic products, computers, phones, and communication equipment.

2. Description of Related Art

As the technology is progressed ceaselessly, the structures of computers, phones, as well as electric and communication equipment are developed to meet the requirements of the present market. However, it is always inconvenient to store the cords or wires of these devices. To solve the problem, various kinds of reels are provided to collect the cords or wires and control the length of cords or wires in use.

Referring to FIG. 1, a reel 10 is utilized by pulling out the wires or cords 101 at two ends with hands, which is single-staged. That is, the reel 10 is not fixed until the cords thereof are completely drawn out. In order to roll up the cords 101, users need to drag and release the cords 101 at two ends simultaneously, and thereby the cords 101 are collected automatically. Another kind of reel 10 belongs to a multi-staged reel, in which the cords 101 are drawn out and fixed in multiple stages. Though the cords 101 can be fixed in multiple stages while being pulled, it is difficult to define the length of the cords 101 and then adjust the length. Moreover, it is still unfavorable to reel out the cords 101 at two ends concurrently because the process needs to be repeated several times for entire collection of the cords 101.

In view of the aforesaid disadvantages, there is a need not only to adjust and define the length of cords or wires in use, but also to wind the cords or wires through such an easy approach as pressing a button. Hence, a reel that satisfies the concerns of convenience and utility is investigated and filed as an US patent application, which has been granted as U.S. Pat. No. 7,147,177 now.

Based on the granted patent, an improved structure of a reel is further investigated and provided in this application.

SUMMARY OF THE INVENTION

It is one object of the invention to provide an improved structure of a reel. The reel is designed and configured based on the structure described in U.S. Pat. No. 7,147,177. The reel includes a fine-tuning structure for adjusting the length of wires or cords drawn from the reel and a button component for winding the wires or cords. By this reel, the length of cords or wires is adjusted to a desired level in multiple stages. Additionally, the cords or wires of such reel are collected quickly and smoothly.

DETAILED DESCRIPTION OF THE INVENTION

Figure 1:
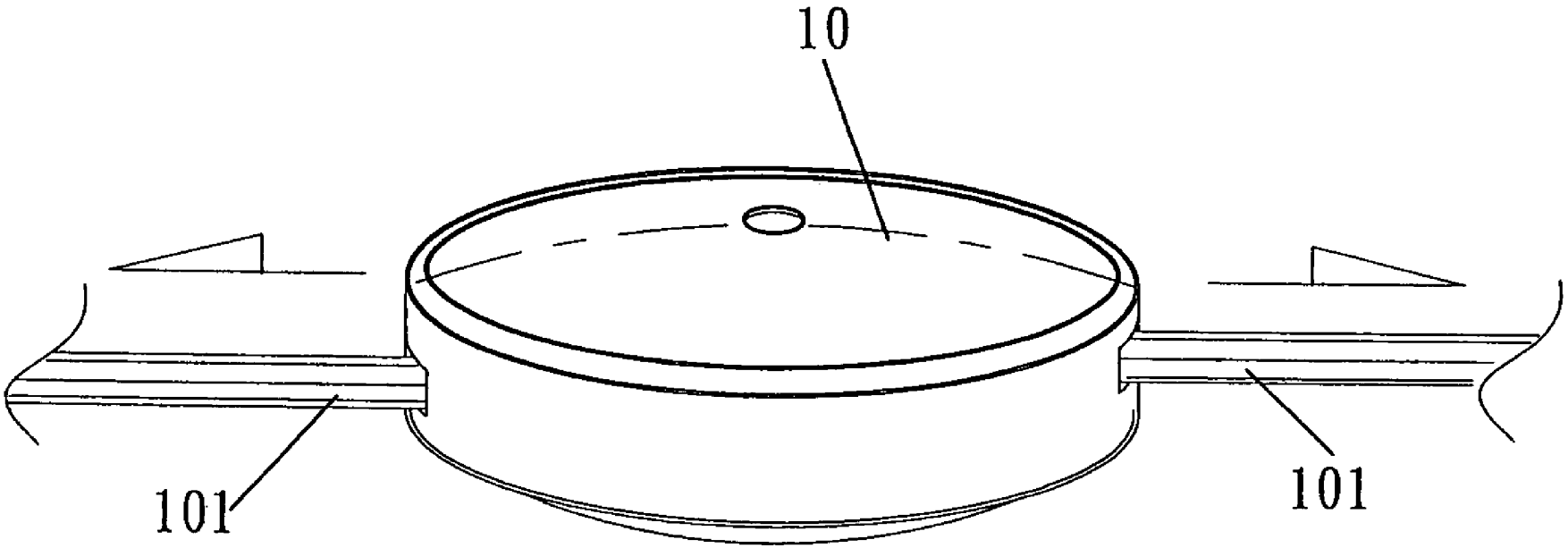
FIG. 1 (PRIOR ART)
FIG. 1 is a diagram of operating a conventional reel.
Figure 2:
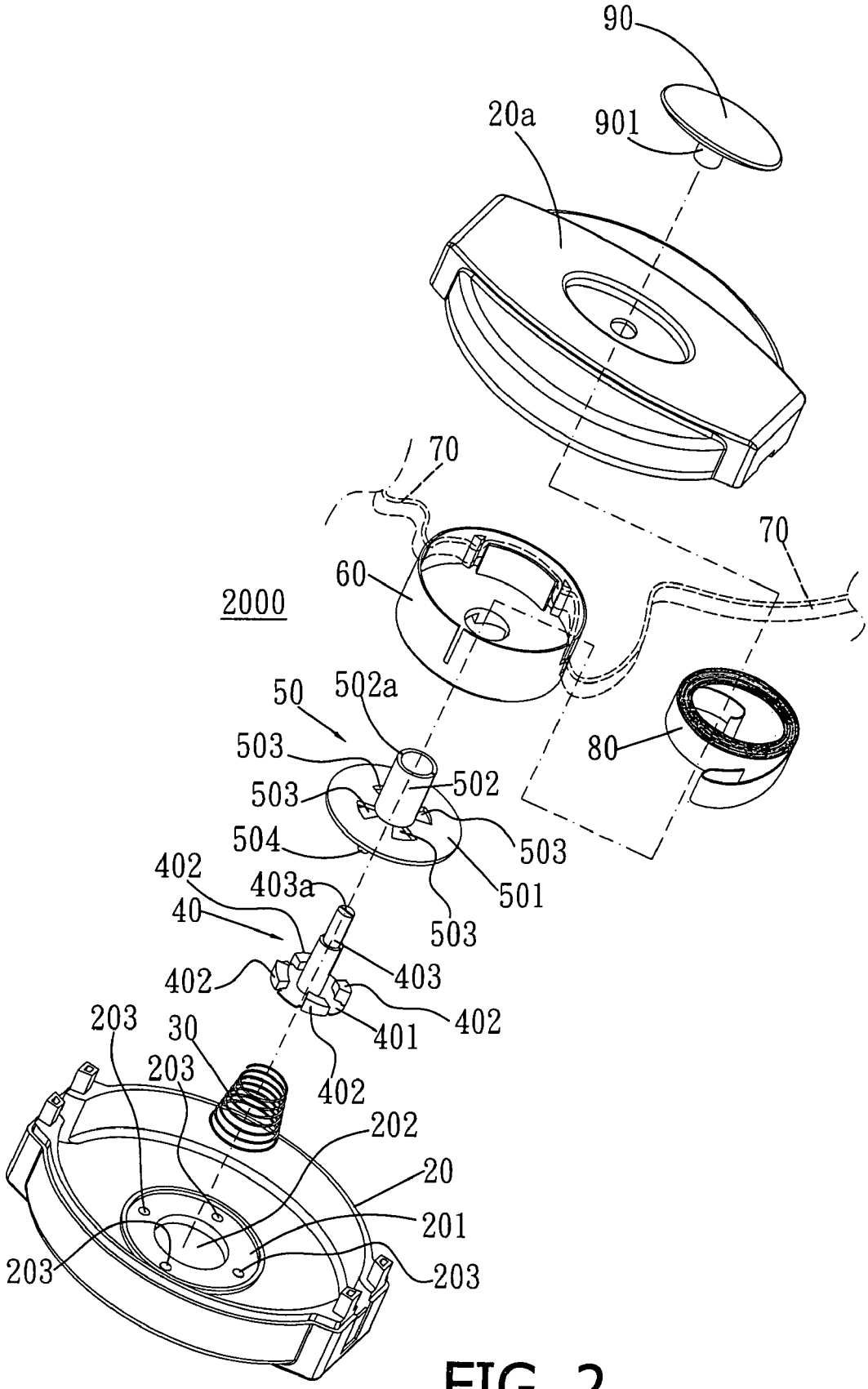
FIG. 2 is an exploded diagram showing various components in a reel according to an embodiment of the invention.

FIG. 2 is an exploded diagram showing various components in a reel according to an embodiment of the invention. As shown, a base trench 201 is disposed in the middle of a bottom housing 20. A spring trench 202 is depressed in the middle of the base trench 201 for accommodating a spring 30. A plurality of plugholes 203 is positioned between the base trench 201 and the spring trench 202.

Figure 4:
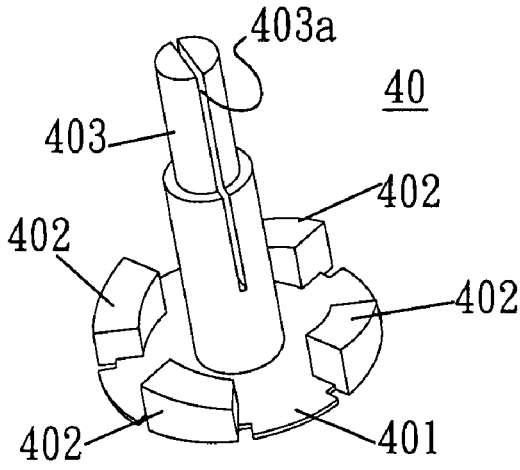
FIG. 4 is a perspective view of a movable shaft assembly according to an embodiment of the invention.

Referring to FIG. 4, a movable shaft assembly 40 includes a bottom plate 401. Several bumps 402 beveled in the same direction are disposed on the edge of the bottom plate 401. An axial support 403 with a groove 403*a* is disposed in the middle of the bottom plate 401.

Figure 3:
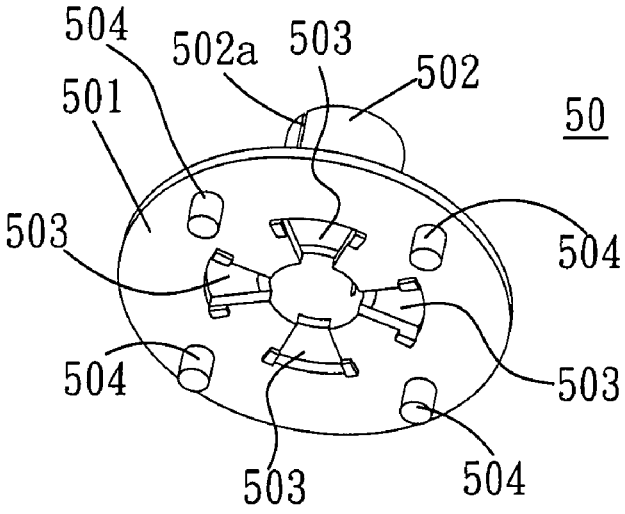
FIG. 3 is a perspective view of a tubular shaft assembly according to an embodiment of the invention.

Also referring to FIG. 3, a tubular shaft assembly 50 includes a base plate 501. A tubular shaft 502 with a groove 502*a* is extended from the middle of the base plate 501. The base plate 501 further includes a plurality of sliding openings 503. A plurality of plugs 504 is disposed at the bottom of the base plate 501.

Figure 5:
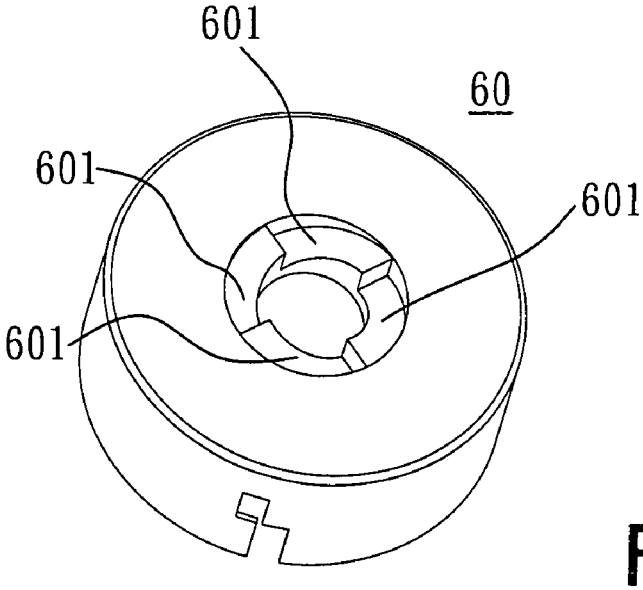
FIG. 5 is a perspective view of the bottom of a rotating disc according to an embodiment of the invention.
Figure 6:
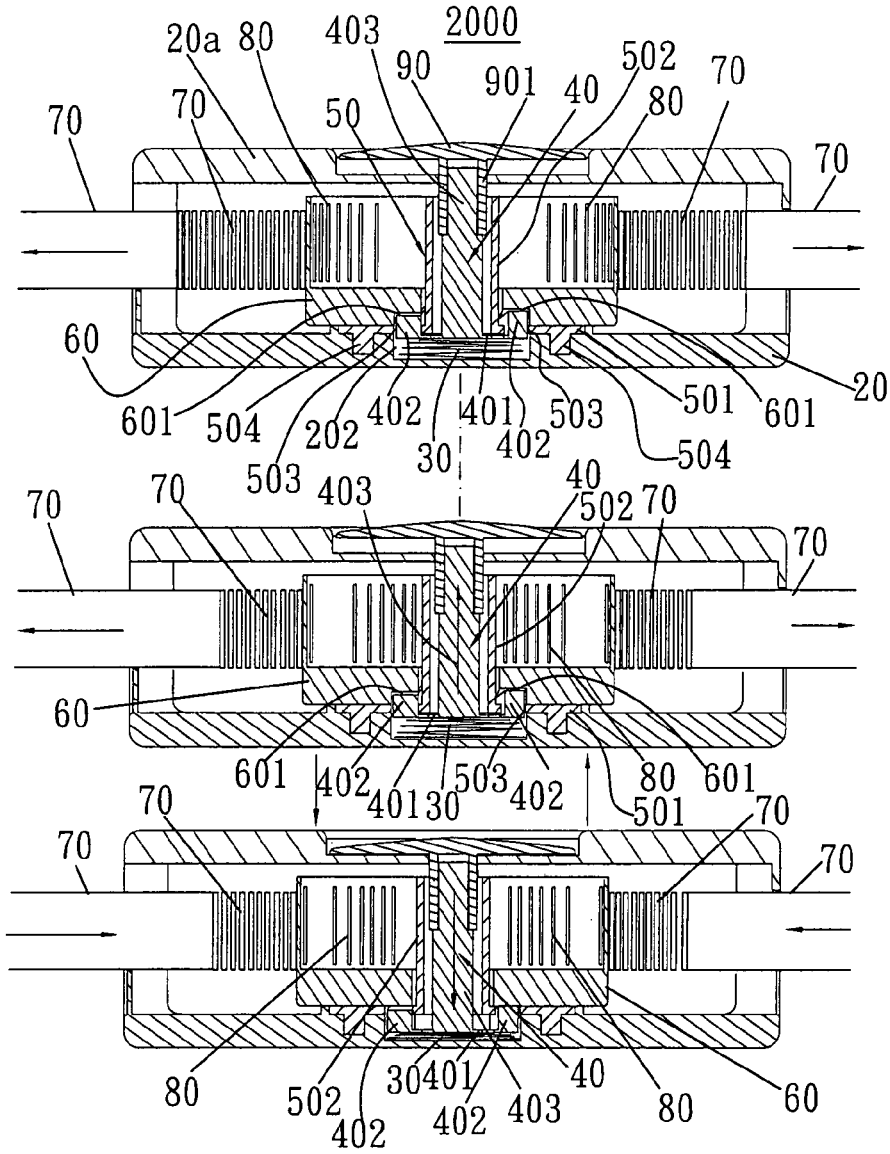
FIG. 6 is a cross-section view of a reel according to an embodiment of the invention, in which the cords are drawn out.

The axial support 403 of the movable shaft assembly 40 is inserted into the tubular shaft 502. The bumps 402 on the bottom plate 401 of the movable shaft assembly 40 are correspondingly put in the sliding openings 503 on the base plate 501 of the tubular shaft assembly 50, and may move back and forth therein. The plugs 504 at the bottom of the base plate 501 are inset to the plugholes 203 of the bottom housing 20, respectively. As such, the spring 30 within the spring trench 202 pushes the bottom plate 401 of the movable shaft assembly 40 constantly. A rotating disc 60 is provided for containing wound cords 70 and has a coil spring 80. The rotating disc 60 is set in the tubular shaft 502 of the tubular shaft assembly 50 and rotates about the tubular shaft 502. The initial end of the coil spring 80 is attached to the groove 403*a* of the axial support 403 and the groove 502*a* of the tubular shaft 502. The terminal of the coil spring 80 is fixed on the edge of the rotating disc 60. Referring to FIG. 5 and FIG. 6, several fastening trenches 601 in the form complementary to the beveled bumps 402 of the movable shaft assembly 40 are depressed at the bottom of the rotating disc 60 and engage with the bumps 402. A top housing 20*a* covers the resultant structure. A tube 901 of a button component 90 passes through a through hole in the center of the top housing 20*a*, and is sleeved onto the axial support 403 of the movable shaft assembly 40, so as to constitute a reel 2000.

Figure 7:
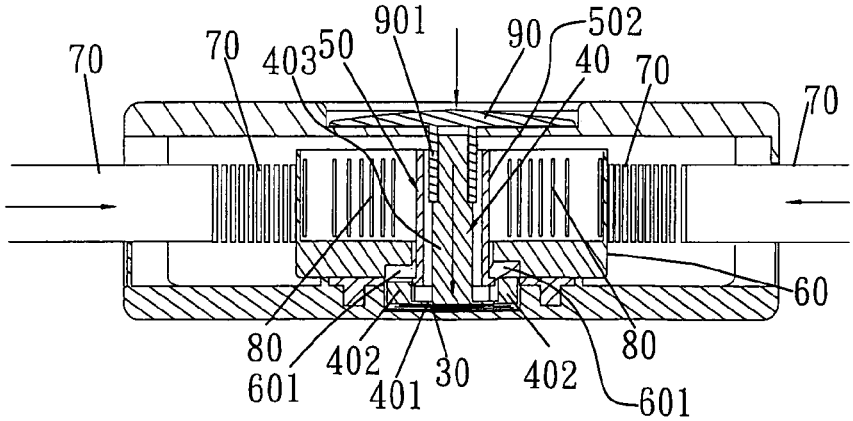
FIG. 7 is a cross-section view of a reel according to an embodiment of the invention, in which the cords are rolled up.

Simultaneously referring to FIGS. 3-6, the rotating disc 60 is turned by drawing out the cords 70 of the reel 2000. The beveled fastening trenches 601 at the bottom of the rotating disc 60 mate with the beveled bumps 402 on the bottom plate 401 of the movable shaft assembly 40, so both of them rotate in the same direction. The spring 30 pushes against the bottom of the bottom plate 401; hence, the bumps 402 and the fastening trenches 601 are fastened together and separated from each other alternately and repeatedly, i.e. the movable shaft assembly 40 axially moves up and down continuously. As the rotating disc 60 rotates, the fastening trenches 601 thereof engage with the beveled bumps 402 on the bottom plate 401 of the movable shaft assembly 40, and the fastening trenches 601 and the beveled bumps 402 are then fixed mutually. When they are separated, the cords 70 can be drawn out in multiple stages, and its length is adjusted to a desired level as required. Moreover, the coil spring 80 is reeled in towards the tubular shaft 502 while the rotating disc 60 is turned, so as to create a strong reverse tension. Since the fastening trenches 601 at the bottom of the rotating disc 60 are coupled with the beveled bumps 402 on the bottom plate 401 of the movable shaft assembly 40, it avoids the opposite rotation of the rotating disc 60 and the rolling up of the cords caused by the reverse tension from the coil spring 80. Referring to FIG. 7, in order to roll up the cords 70, the button component 90 is pressed to force the movable shaft assembly 40 to move downwards. As a result, the bumps 402 are separated from the fastening trenches 601 of the rotating disc 60, and the reverse tension from the coil spring 80 is released. Meanwhile, the rotating disc 60 is turned in the opposite direction to wind and collect the cords 70 in the reel 2000.

In accordance with the description above, the reel structure possesses the benefit of adjusting the cords reeled in or out in multiple stages. The structure is not known to the public, and has utility and novelty. It is appreciated if the application is examined and granted.

The aforementioned embodiments of the present invention are intended to be illustrative only. Numerous alternative embodiments may be devised by those skilled in the art without departing from the scope of the following claims.

What is claimed is:

1. An improved reel structure comprising:

a bottom housing having a base trench disposed in a middle of the bottom housing, a spring trench depressed in a middle of the base trench for accommodating a spring, and a plurality of plugholes positioned between the base trench and the spring trench;

a movable shaft assembly including a bottom plate with a plurality of bumps beveled in a same direction and disposed on an edge of the bottom plate, and an axial support with a groove disposed in a middle of the bottom plate;

a tubular shaft assembly including a tubular shaft with a groove extended from a middle of a base plate, a plurality of sliding openings positioned on the base plate, and a plurality of plugs disposed at a bottom of the base plate;

wherein, the axial support of the movable shaft assembly is inserted into the tubular shaft, the bumps on the bottom plate of the movable shaft assembly correspondingly inserted in the sliding openings on the base plate of the tubular shaft assembly to move back and forth therein;

the plugs at the bottom of the base plate are inset to the plugholes of the bottom housing, respectively, the spring within the spring trench thereby pushing the bottom plate of the movable shaft assembly;

a rotating disc for containing wound cords and having a coil spring is set in the tubular shaft of the tubular shaft assembly and rotates about the tubular shaft, wherein an initial end of the coil spring is attached to the groove of the axial support and the groove of the tubular shaft;

a terminal end of the coil spring is fixed on an edge of the rotating disc;

a plurality of fastening trenches of the movable shaft assembly in a form complementary to the beveled bumps are depressed at a bottom of the rotating disc and engage with the bumps;

a top housing substantially covers the bottom housing; and a tube of a button component passes through a through hole in a center of the top housing and is sleeved onto the axial support of the movable shaft assembly.

* * * * *